US006681724B1

(12) United States Patent
Berg

(10) Patent No.: US 6,681,724 B1
(45) Date of Patent: Jan. 27, 2004

(54) SNOWMOBILE COOLING SYSTEM

(75) Inventor: Jeffrey J. Berg, Warrodd, MN (US)

(73) Assignee: Polaris Industries Inc., Medina, MN (US)

( * ) Notice: Subject to any disclaimer, the term of this patent is extended or adjusted under 35 U.S.C. 154(b) by 31 days.

(21) Appl. No.: 10/027,144

(22) Filed: Dec. 20, 2001

(51) Int. Cl.[7] ..... F01P 7/02
(52) U.S. Cl. ..... 123/41.1; 123/41.51
(58) Field of Search ..... 123/41.08, 41.09, 123/41.51, 41.29, 41.1

(56) References Cited

U.S. PATENT DOCUMENTS

| | | | | |
|---|---|---|---|---|
| 1,962,134 A | * | 6/1934 | Brubaker | 123/41.08 |
| 3,835,948 A | | 9/1974 | Duclo | |
| 3,877,536 A | | 4/1975 | Earhart | |
| 3,901,335 A | | 8/1975 | Johnson | |
| 5,129,473 A | | 7/1992 | Boyer | |
| 5,152,255 A | | 10/1992 | Fukuda | |
| 5,167,294 A | | 12/1992 | Gessinger | |
| 5,232,066 A | | 8/1993 | Schnelker | |
| 5,568,840 A | | 10/1996 | Nagata et al. | |
| 5,957,230 A | | 9/1999 | Harano et al. | |
| 6,109,217 A | | 8/2000 | Hedlund et al. | |

* cited by examiner

*Primary Examiner*—Noah P. Kamen
(74) *Attorney, Agent, or Firm*—Fredrikson & Byron, P.A.

(57) ABSTRACT

A snowmobile having a liquid-cooled engine with an improved cooling system is disclosed. The engine is connected between the inlets and outlets of first and second coolant circuits that are each comprised of one or more interconnected heat exchangers. The coolant circuits circulate coolant pumped from the engine and dissipate heat generated by the engine during its operation. A thermostat valve is operatively connected to one of the second coolant circuit and blocks coolant flow in the circuit when the engine temperature is below a threshold level. The first coolant circuit provides the main cooling circuit for the engine. The second cooling circuit provides a parallel cooling path that enhances the cooling capacity of the cooling system when the engine temperature exceeds the threshold.

39 Claims, 8 Drawing Sheets

SNOWMOBILE COOLING SYSTEM

FIELD OF THE INVENTION

The present invention relates to cooling systems for endless track vehicles. Particularly, the present invention relates to snowmobiles having an improved cooling system. More particularly the present invention relates to a heat exchanger assembly utilized in snowmobile vehicles having liquid-cooled engines.

BACKGROUND OF THE INVENTION

The invention is particularly applicable to self propelled snow vehicles more commonly referred to as snowmobiles and will be described with particular reference thereto; however, it will be appreciated by those skilled in the art that the invention has broader applications and may be advantageously employed in other types of vehicles requiring the use of small, fluid-cooled internal combustion engines.

Past snowmobiles have used-liquid cooling systems to cool their internal combustion engines. Snowmobiles with these liquid-cooled engines often have auxiliary radiators (also known as heat exchangers or coolers) spaced away from the engine itself. In some of these snowmobiles, the radiators are positioned within the drive tunnel, which is within the snowmobile chassis. The drive track, also disposed within the drive tunnel, carries and circulates snow within the drive tunnel as the track moves. The radiators are positioned adjacent the track so that some of the snow carried by the track will be thrown at the radiators to provide a heat exchange. The melting of snow requires a substantial amount of heat, which is removed from the coolant circulated in the radiators.

Aside from circulating snow within the tunnel, the drive track in typical snowmobiles will throw snow onto the snowmobile operator's foot area. Since typical snowmobiles provide recessed footwells for a rider's feet, the snow kicked up by the track and by movement of the machine tends to accumulate in the recesses of the footwells. The accumulated snow not only adds undesirable weight to the machine, but it may also cause the rider's feet to slip from the snowmobile.

These heat exchangers (front, rear, left side, right side) and the rubber hoses that interconnect the heat exchangers form a coolant "circuit". For instance, a typical prior art series coolant circuit is shown schematically in FIG. 1. The circuit includes a right cooler 100, a rear cooler 102, a left cooler 104 and a front cooler 106. Each of the coolers are connected via flexible or formed hoses 108. The inlet side of the coolant circuit is connected to the engine 110 via a thermostat valve 112, as described below. The outlet of the coolant circuit is connected back to the engine 110 via a coolant pump 114. Often times, a coolant overflow reservoir 116 is inserted in the coolant circuit.

Typical engine thermostats 112 comprise temperature-actuated valves that open only when the engine temperature exceeds a threshold level (e.g., 120° F.). When the engine temperature falls back below the threshold, the thermostat valve 112 closes. When the thermostat valve 112 is opened, the coolant is pumped via pump 114 through the circuit components generally in the following order: engine 110, right side cooler 100, rear cooler 102, left side cooler 104, front cooler 106, overflow reservoir 116, and back to pump 114. The flow of coolant through the coolers dissipates heat generated by the engine during its operation.

On conventional liquid cooled engines 110 having a thermostat valve 112, a second coolant outlet 118 is found (either as part of the thermostat or on the engine separate from the thermostat 112). As shown in FIG. 1, coolant from outlet 118 is routed back to the pump 114 directly (via hose 108 as shown in FIG. 1) or almost directly (by first passing through the overflow reservoir 116 which is connected to the pump 114).

Under this conventional configuration, at temperatures below the thermostat's threshold, thermostat 112 is closed (cutting off fluid flow to all coolers) and outlet 118 remains open. Under these conditions (typically during initial engine warm-up), coolant is circulated out outlet 118 and directly back to the pump 114. Such direct or short circuit routing (bypassing all coolers) allows the engine to heat up to normal operating temperature as quickly as possible. Outlet 118 is used to direct the coolant back into engine 110 through pump 114 to achieve this objective. Then, once the engine reaches the thermostat's threshold temperature, thermostat 112 opens to allow coolant to travel through the series coolant circuit 100, 102, 104, 106. If the water temp falls again below the threshold, thermostat 112 closes until the threshold is reached again.

In certain conventional cooling systems, a "popit" style thermostat 112 is used. A popit thermostat closes outlet 118 under certain conditions. The popit style thermostat comprises a valve that has internally a flat disc that seals off outlet 118 and opens thermostat 112 when the temperature threshold is exceeded (allowing coolant to flow only out the thermostat 112 and to the cooling circuit. Conversely, the popit thermostat seals off thermostat 112 and opens outlet 118 at temperatures below the threshold (allowing coolant to flow only through outlet 118).

In either of these past designs, air is allowed to build up in the coolers and in the connecting hoses when coolant is not being pumped through them. When the past designs reached the temperature threshold and started pumping coolant, the air is eventually pumped out of the coolers and the hoses and into the overflow reservoir. Until the air is pumped out, though, the system does not provide maximum cooling. Air, of course, does not have the heat transfer capabilities of the engine coolant.

SUMMARY OF THE INVENTION

The invention provides a snowmobile with a liquid-cooled engine, first and second coolant circuits, and a pump. The engine has a cooling jacket that carries liquid that absorbs heat generated by the engine during operation. The first and second coolant circuits dissipate heat generated by the engine and each include at least one of a front cooler, a rear cooler, a left side cooler, and a right side cooler. The jacket is operatively connected with the coolers in the first and second cooling circuits. The jacket is connected between a respective inlet and outlet of each cooling circuit. The pump is used to circulate coolant through the cooling jacket and the cooling circuits. A thermostat valve is operatively connected to the second coolant circuit. The valve is biased to a closed position, blocking the pump's circulation of coolant at a location in the second coolant circuit without blocking coolant circulation in the first coolant circuit. The valve opened when the engine temperature exceeds a predetermined threshold, thereby permitting coolant circulation in the second coolant circuit in order to increase the engine heat dissipated.

The outlets of the cooling circuits may share a common passage. In addition, the first coolant circuit may include the front cooler, the rear cooler, and the side coolers. The second coolant circuit may include the front cooler.

In one embodiment, the front cooler includes two inlets, one inlet for connection within each coolant circuit, and may have just one outlet, shared by each coolant circuit.

One embodiment of the invention takes advantage of the engine's two outlets. Instead of routing the open outlet directly into the overflow reservoir, the present invention routes the open outlet into the first coolant circuit which is comprised of one or more of a left cooler, right cooler, rear cooler, and front cooler. Under this configuration, the first coolant circuit is always cooling the engine during its operation, in contrast to the prior art where coolers were only employed once an engine temperature threshold was exceeded. By providing constant cooling through the first coolant circuit, air is not allowed to build up in the circuit. The second engine outlet, which is valved by a thermostat, is connected to a second coolant circuit. The second coolant circuit is comprised of one or more of the left cooler, right cooler, rear cooler, and front cooler. Under this configuration, the second cooling circuit provides additional cooling capacity when the engine threshold temperature is exceeded.

DETAILED DESCRIPTION OF PREFERRED EMBODIMENT

Figure 1:
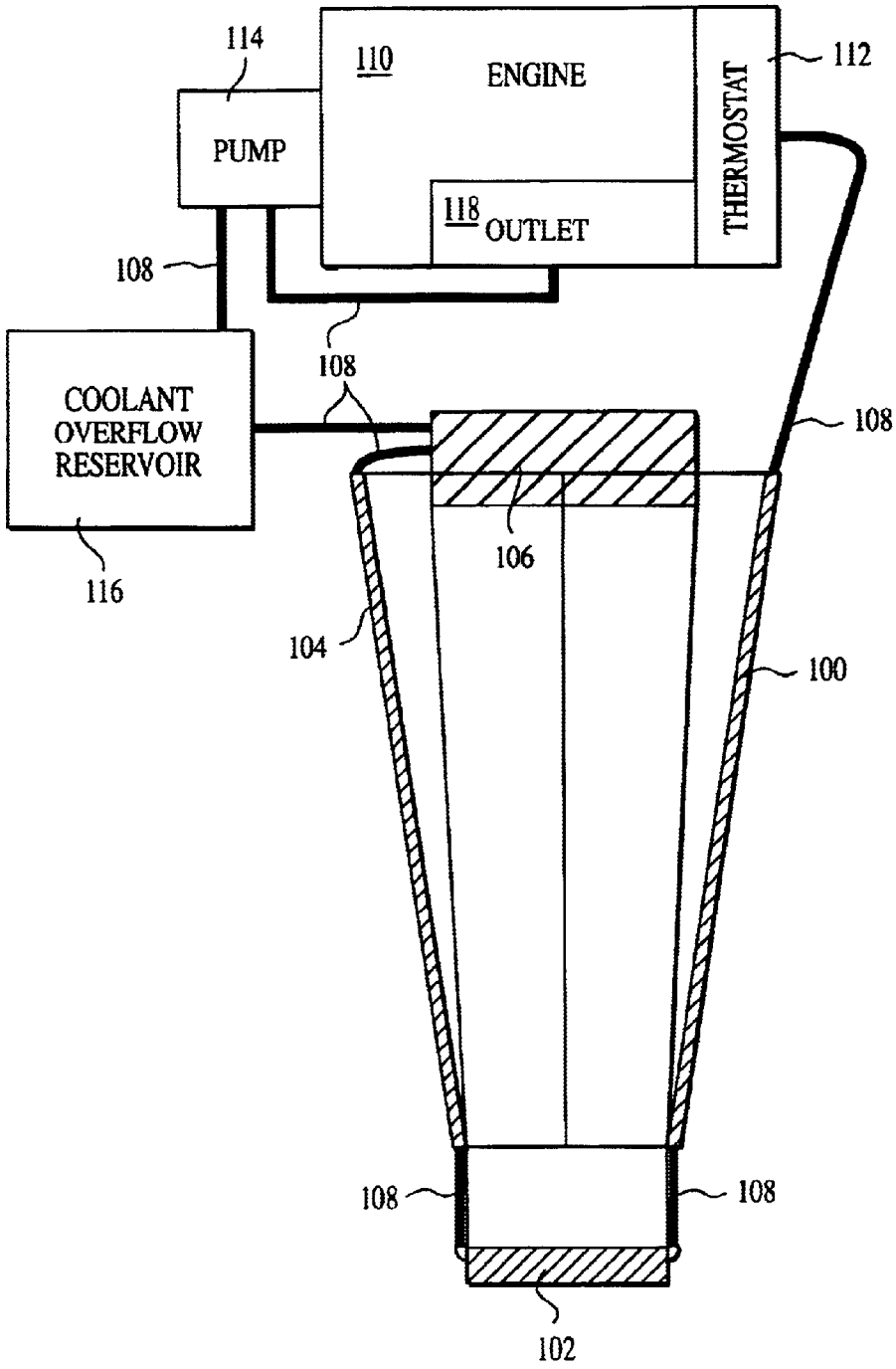
FIG. 1 PRIOR ART
FIG. 1 is a top-view schematic view of a prior art cooling system.

To assist in an understanding of the invention, a preferred embodiment or embodiments will now be described in detail. Reference will be frequently taken to the drawings, which are summarized above. Reference numerals will be used to indicate certain parts and locations in the drawings. The same reference numerals will be used to indicate the same parts or locations throughout the drawings unless otherwise indicated.

Figure 2:
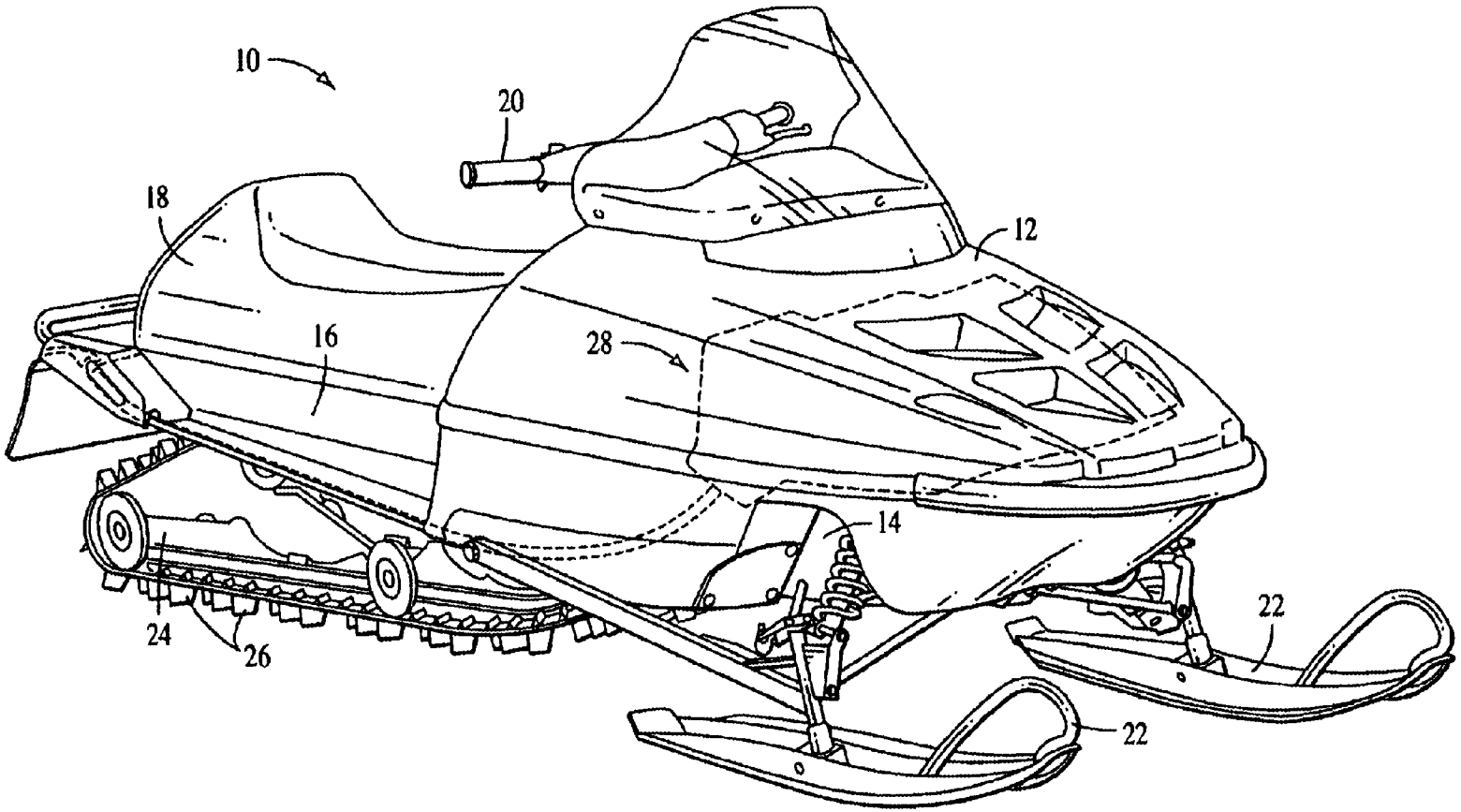
FIG. 2 is a perspective view of a snowmobile having the cooling system of the present invention.

A snowmobile 10 having an improved cooling system in accordance with one embodiment of the invention is illustrated in FIG. 2. Snowmobile 10 includes a body assembly 12 made up of a number of parts, which may be formed of suitable materials that cover and protect a support frame or chassis 14. Body 12 further includes a rear body portion 16 that accommodates a seat 18 adapted to seat one or more riders in straddle fashion. A handlebar assembly 20, positioned forwardly of the seat, is conventionally connected to a pair of front skis 22 for steering the snowmobile. Skis 22 are supported by a suitable front suspension system, which is connected to chassis 14.

Rearward of front skis 22 and beneath seat 18, chassis 14 suspends an endless track assembly 24 by a suitable suspension. Endless track 24 has a plurality of spaced ribs 26 which extend from the exterior surface of the track. Ribs 26 not only provide traction to endless track 24 but also assist in providing added cooling to the improved cooling system. Endless track 24 is driven by an internal combustion engine indicated generally by reference numeral 28 (the location of which is shown generally by dotted lines in FIG. 2) which is supported by chassis 14 and located in an engine compartment within body 12 towards the front of snowmobile 10. Engine 28 is liquid-cooled and contains internal passages or a jacket for carrying liquid coolant that absorbs heat generated by engine 28 during operation. Snowmobile engine 28 is typically a two-stroke engine; however, the invention is not limited to merely two-stroke type engines.

Figure 3:
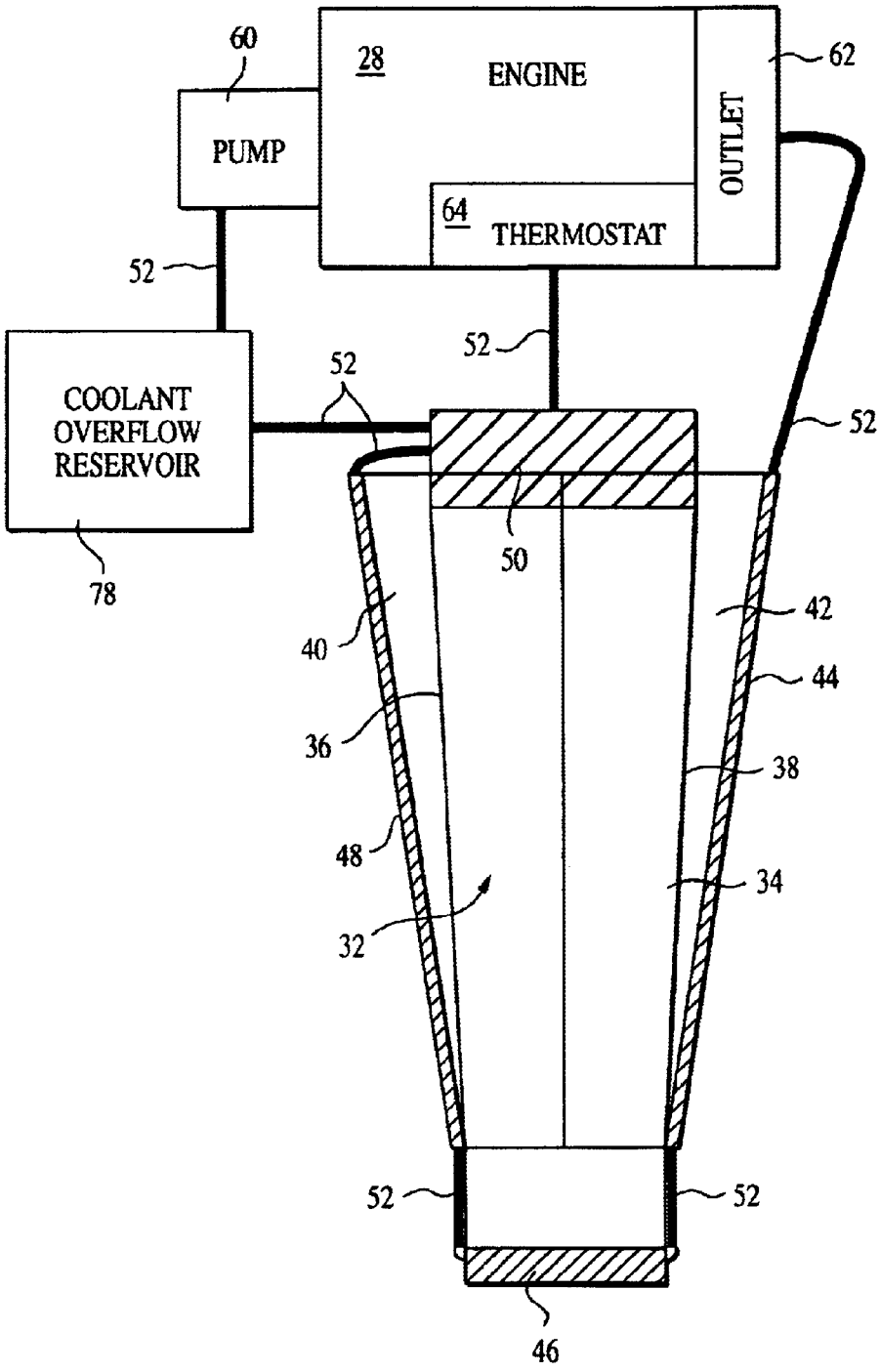
FIG. 3 is a top-view schematic of the cooing system of the present invention.
Figure 4:
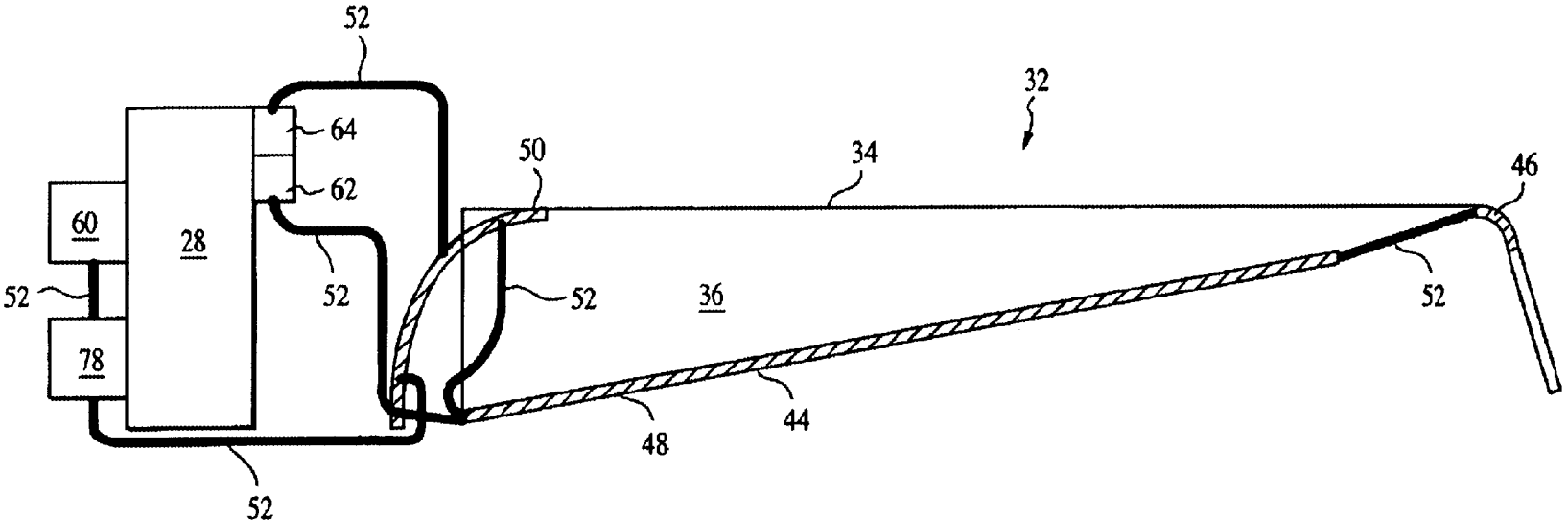
FIG. 4 is a side view schematic of the cooling system of the present invention.

Referring now to FIGS. 2–4, beneath seat area 18 and disposed around endless drive track 24, snowmobile 10 has a longitudinally extending drive tunnel 32 support frame supported by chassis 14. Drive tunnel 32 can be made of a thermally conductive material such as aluminum, and can be comprised of a single sheet or several sections connected together. Drive tunnel 32 has a top portion 34 under seat 18. Top portion 34 connects to generally downwardly extending sidewalls 36, 38 (shown schematically in FIG. 4) that are positioned on opposite sides of endless track 24 so that endless track 24 is disposed within drive tunnel 32 or at least within its lateral confines. Generally horizontal footrests 40, 42 extend outward from chassis 14, or they extend outward from each sidewall 36, 38, respectively. Footrests 40, 42 can be made of a thermally conductive material and can be formed integrally with drive tunnel 32 (and therefore being thermally conductive therewith). The width of footrests 40, 42 preferably tapers rearward.

The heat exchangers or coolers on the snowmobile will now be described. With reference to FIGS. 3 and 4, snowmobile 10 has a series of coolers including a right side cooler 44, a rear cooler 46, a left side cooler 48, and a front cooler 50. The coolers are interconnected via flexible hoses or tubes 52. Alternatively, the tubes 52 could be eliminated and the coolers could be directly interconnected.

The heat exchangers are somewhat conventional. Each of the heat exchangers 44, 46, 48, and 50 has hollow internal passages to permit coolant flow. Preferably, the coolers are made of a thermally conductive material such as aluminum that allows heat to be conducted from the coolant to the heat exchangers. The 44, 46, 48, and 50 may also have several integrally formed heat exchanging fins to increase the coolers' surface area to help radiate heat. The fins also provide a rough surface to capture and hold snow kicked up by the movement of the endless track 24. The snow, of course, helps cool the coolers and the coolant flowing therethrough.

The elongated side coolers 44, 48 are preferably mounted to or adjacent to a respective footrest 40, 42 as is well-known. The side coolers 44, 48 may be mounted along either or both of the underside and the outside edge of a respective footrest. The side coolers 44, 48 could alternatively be mounted along the inside sidewalls 36, 38 of the tunnel 32. By mounting the thermally conductive coolers 44, 48 to the thermally conductive footrests and/or the tunnel 32, heat is dissipated into footrests and/or the tunnel.

The front cooler 50 and rear cooler 46 are preferably mounted to or adjacent to the front and rear of the tunnel 32, respectively, as is well-known. Since the coolers 46 and 50 and the drive tunnel 32 are preferably comprised of thermally conductive materials, the coolers 46 and 50 may dissipate heat into the drive tunnel 32 to increase the system's cooling capacity. As shown best in FIG. 3, the rear cooler 46 is a close-off or crossover cooler that provides for circulation of the fluid from one side of the tunnel to the other.

Figure 5:
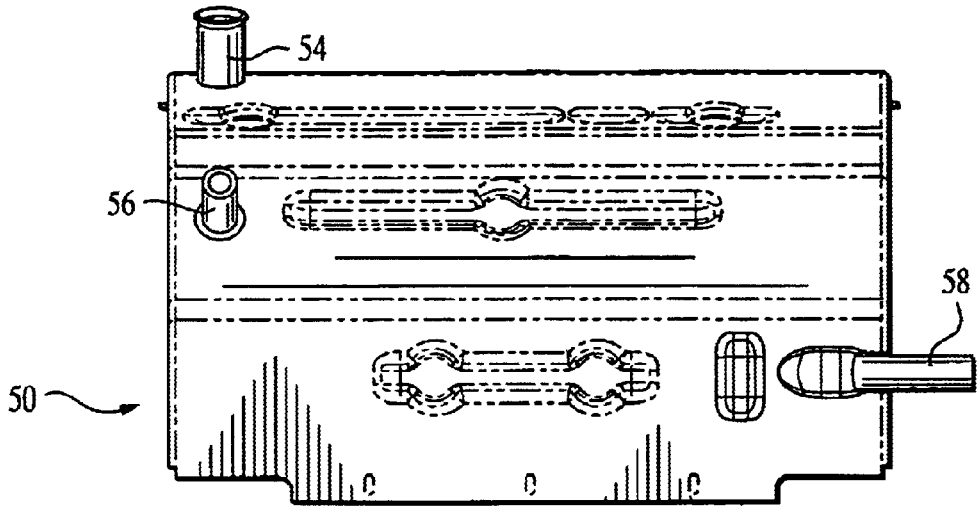
FIG. 5 is a plan view of a front cooler of one embodiment of the present invention.
Figure 6:
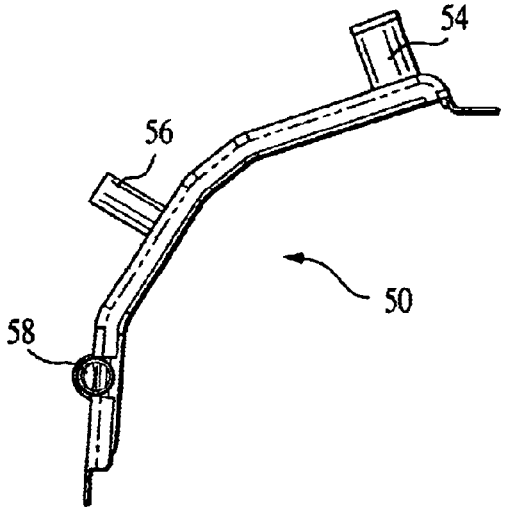
FIG. 6 is a side view of the front cooler shown in FIG. 5.

Other than the front cooler 50, each cooler has only a single inlet and single outlet in the embodiment shown in FIGS. 3 and 4. A preferred design of the front cooler 50 for this same embodiment is shown in FIGS. 5 and 6. As shown in these figures, the front cooler 50 has three connections. As will be discussed below, these connections provide a first inlet 54, a second inlet 56, and an outlet 58. Coolant entering cooler 50 through separate inlets 54, 56 blends together within the interior of the cooler 50 before it exits out the outlet 58. The invention is not limited to the front cooler having multiple inlets and outlets. The other coolers 44, 46, and 48, in addition to or instead of the front cooler 50, could be designed with multiple inlets and outlets.

Referring back to FIGS. 3 and 4, the coolers 44, 46, 48, and 50 are connected to engine 28 via hoses 52 for circulation of coolant (typically an ethylene-glycol mixture) through the coolers. Engine 28 contains a conventional pump 30 for circulating the liquid coolant from engine 28 through the snowmobile's heat exchangers 44, 46, 48, and 50. Pump 60 can be mounted internal or external to engine 28. Pump 60 may operate in either direction, pushing or pulling coolant into or out of engine 28. In the preferred embodiment shown, pump 60 pushes coolant into engine 28.

Engine 28 also contains two coolant outlets, an open outlet 62 and a thermostat outlet 64. Both outlets pass the coolant from engine 28 through to the coolers.

Figure 7:
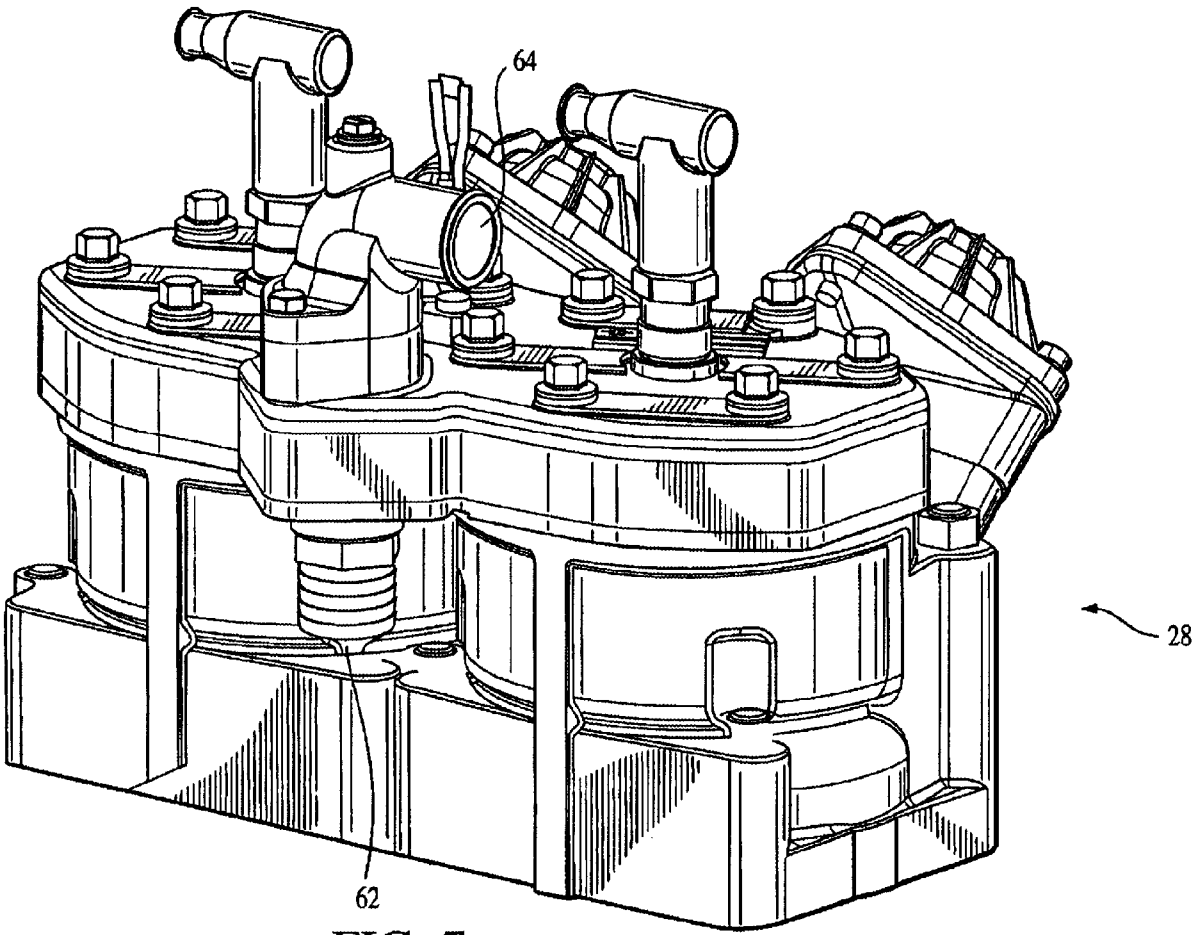
FIG. 7 is a perspective view of a portion of the engine of the present invention.
Figure 8:
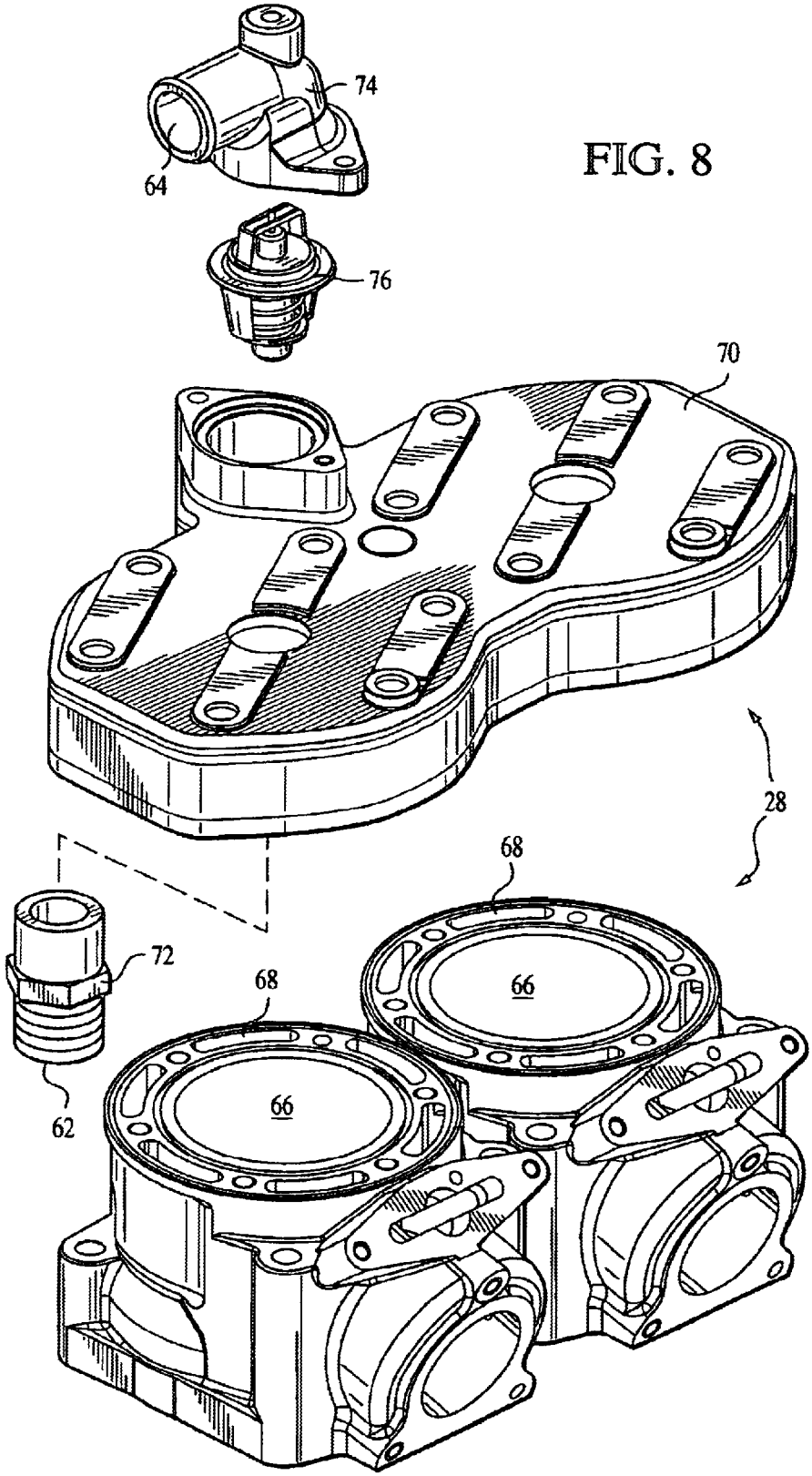
FIG. 8 is an exploded view showing some of the engine components in FIG. 7.

Referring to FIGS. 7 and 8, a portion of engine 28 is shown. In particular, engine 28 includes twin cylinders 66 that are each surrounded by internal passages or a water jacket 68 within which coolant is circulated to absorb heat from the cylinders 66. Cylinder head 70 mounts on top of the cylinders 66 in a conventional manner. Coolant is pumped via pump 60 (not shown in FIGS. 7 and 8) through the water jacket 68 and out of cylinder head 70 via the open outlet 62 and the thermostat outlet 64. A hose fitting 72 connected from cylinder head 70 provides open outlet 62. Since this outlet 62 is not valved or controlled in the preferred embodiment, it remains open to route coolant continuously out of engine 28.

A thermostat cover 74 connected on top of cylinder head 70 provides thermostat outlet 64. Thermostat cover 74 holds a conventional thermostat valve 76 that valves outlet 64. Valve 76 is biased to close outlet 64. When engine 28 temperature exceeds a threshold temperature (e.g., 120° F.), valve 76 opens outlet 64 allowing coolant to be pumped by pump 30 through jacket 68 and out thermostat outlet 64.

Valve 76 could also be located separately from the engine, at some location in the second cooling circuit. In an alternative embodiment, valve 76 could be controlled by an operating parameter other than temperature. For instance, valve 76 (whether or not it is located on, in, or distant from the engine) could be controlled via suitable manual or electronic control mechanisms (e.g., electronic control unit, pressure-sensitive valves, RPM sensors, etc.) to open or shut (entirely or partially) in response to predetermined vehicle or engine operating conditions.

In past cooling system designs, as shown in FIG. 1 and as described more fully above, coolant from thermostat outlet 112 (analogous to thermostat outlet 64) is routed to the heat exchangers only when the engine temperature exceeds the thermostat threshold. Coolant from an open outlet 118 (analogous to outlet 62) bypasses all heat exchangers and is routed via hose 108 directly back into engine 110. Such direct or short circuit routing (bypassing all coolers) of coolant when the engine temperature is below the threshold allows the engine to heat up to normal operating temperature as quickly as possible. It is believed that this configuration was preferred on two-stroke engines, because many of them did not operate as well at temperatures below their normal operating temperature.

Referring back to FIGS. 3 and 4, the coolant flow may be seen. As stated above, engine 28 is liquid-cooled. Pump 60 circulates liquid coolant through internal passages of engine 28 (where heat generated by engine 28 would be absorbed by the coolant) and into several heat exchanging radiators 44, 46, 48, and 50 (where heat is dissipated). The coolant flows in a closed paths of interconnected heat exchangers and hoses or fluid "circuits" back to the pump 60.

In particular, coolant is pumped by pump 60 during engine operation through engine 28, out open outlet 62, and into the inlet of the first of the coolant circuits into radiator hose or tube 52 leading to the first heat exchanger, a side cooler 44 on the right side of the snowmobile 10. From side cooler 44, the coolant flows into another tube 52 and then into the second heat exchanger, the rear cooler 46, via an inlet. Rear cooler 46 is a close-off or crossover cooler that provides for circulation of the fluid from the right side of tunnel 32 to the left side. Coming off the left side of the tunnel and from an outlet of rear cooler 46, the coolant again flows through a hose 52 and into the third heat exchanger, a side cooler 48 on the left side of snowmobile 10. From side cooler 48, the coolant flows into another tube 44 that leads into a first inlet 54 for the fourth heat exchanger, front cooler 50. From an outlet 58 of front cooler 52, the coolant, which is now cold, flows through another hose 52 into coolant overflow reservoir 78. From reservoir 78 via another hose 52, the coolant completes the loop or "first circuit" by flowing out this hose 52 at an outlet of the first circuit back into internal passages 68 in engine 28 through pump 60. Alternatively, tubes 52 could be eliminated and coolers 44, 46, 48, and 50 could be directly interconnected.

If the engine temperature exceeds the thermostat's 76 threshold, the thermostat opens the thermostat outlet 64. Coolant may then be pumped through thermostat outlet 64 and into the inlet of the second of the coolant circuits into radiator hose or tube 52 leading to the second inlet 56 of the front cooler 50. Here the coolant combines with the coolant from the first circuit, and flows out the front cooler outlet 58 back to the engine 28 and pump 60 via the overflow reservoir 78. This closed path of coolant flow from thermostat outlet 64, through heat exchanger 50 and overflow reservoir 78, and back to the engine and pump, via an outlet, defines a second coolant circuit, operating somewhat parallely to the first coolant circuit.

In contrast to the prior art that only routed coolant through heat exchangers once a temperature threshold was reached, the present invention circulates coolant out outlet 62 and through at least one heat exchanger during all engine-operating temperatures. Outlet 62 now becomes the main coolant supply. When thermostat 76 is closed, the system becomes a series coolant system through the first coolant circuit. Once thermostat 76 opens at the threshold level, the coolant splits between outlet 62 and outlet 64, thus creating a parallel cooling system.

Therefore, when the engine temperature exceeds the threshold, indicative of the need for additional and immediate cooling, thermostat outlet 64 provides another path to heat exchangers. This second, parallel coolant path increases the fluid flow through the coolant circuits which, in turn, provides increased cooling capacity when that capacity is needed most.

Constant circulation of coolant through out outlet 62 and through the first coolant circuit has at least two effects. First, air is not allowed to build up in the heat exchangers. Air builds up in the coolers and in the connecting hoses when coolant is not being pumped through them. The air is eventually pumped out of the coolers and the hoses and into the overflow reservoir when the past designs reached the temperature threshold and started pumping coolant. Until the air was pumped out, though, the system does not provide maximum cooling. In the present invention, air is not likely to be present in the coolers when the thermostat 76 opens. The cooling capacity provided by the second cooling circuit is therefore not delayed by the presence of air.

The perceived potentially negative effects realized from the constant circulation of coolant through out outlet 62 and through the first coolant circuit are somewhat insignificant. That is, constant circulation of coolant independent of engine temperature likely increases the time needed for the engine to heat up to its normal operating temperature. Modern two-stroke engines, however, do not run as poorly as their predecessors did at lower temperatures. Thus, such a longer engine heat-up time has very limited effects.

It will be appreciated that the present invention can take many forms and embodiments. The true essence and spirit of this invention are defined in the appended claims, and it is not intended that the embodiment of the invention presented herein should limit the scope thereof.

Figure 9:
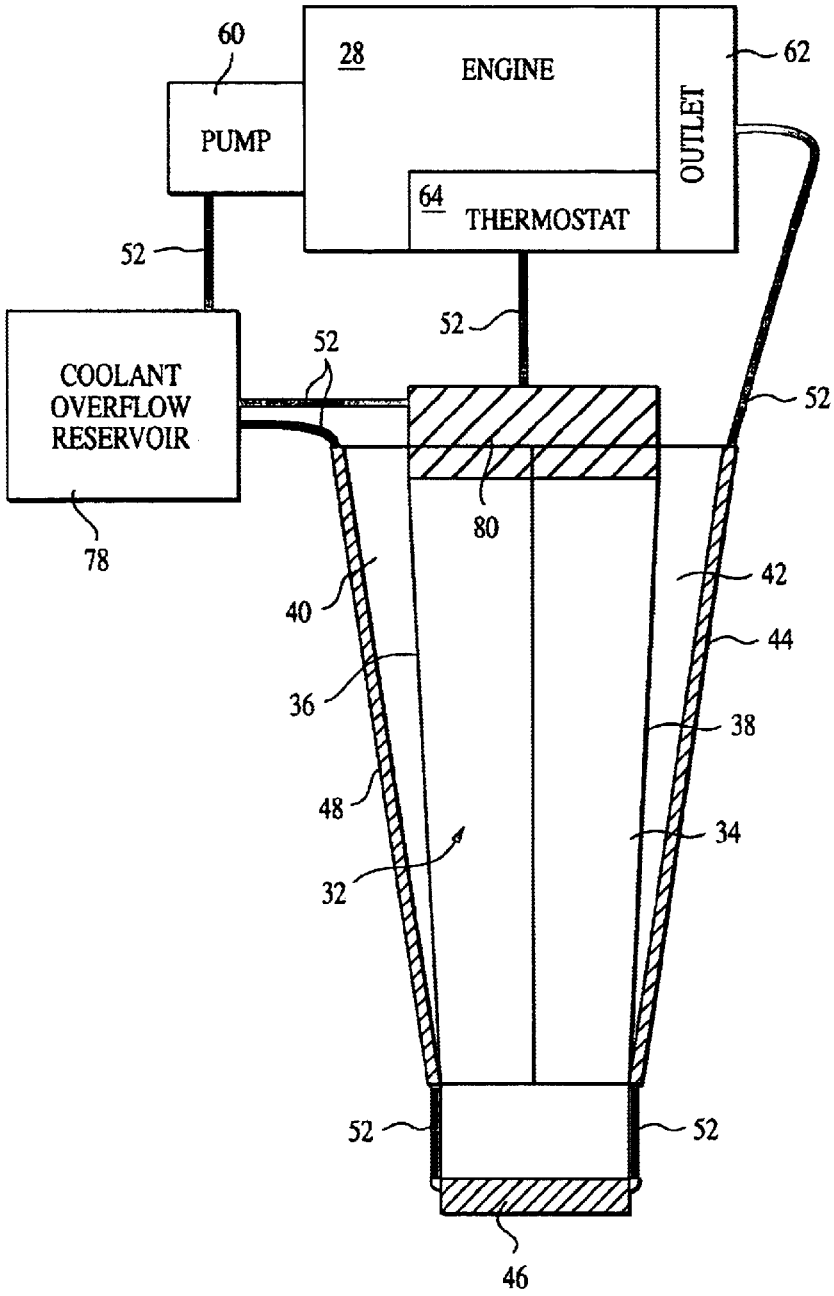
FIG. 9 is a top-view schematic of an alternative embodiment of the cooling system of the present invention.

For example, with reference to FIG. 9, a variation in the coolant circuits is shown. Like reference numerals from other embodiments indicate like components. In particular, as shown by the cooler and engine hose 52 connections, the front cooler is eliminated from the first coolant circuit. Instead, the first coolant circuit is merely comprised of the right 44, rear 46, and left 48 coolers and the overflow reservoir 78. The second circuit still contains a modified front cooler 80. Instead of providing two inlets in the front cooler 80 to merge the two coolant circuits, the circuits are merged at the overflow reservoir 78, via its two inlets (receiving coolant from the first circuit's left cooler 48 and the second circuit's front cooler 80).

Other configurations are within the scope of the present invention. That is, coolers and/or components other than front cooler 50 and overflow reservoir 78 could have multiple inlets and outlets. For instance, a "Y" tube could be used in place of one of the hoses 52 to combine the coolant circuits. The engine 28 or pump 60 could be constructed with two inlets. Moreover, the coolant circuits could split out again into separate coolant paths downstream of their merger. In other configurations, more than two coolant circuits could be used as long as one of them is valved by a thermostat.

What is claimed is:

1. A snowmobile comprising:

a liquid-cooled engine containing a cooling jacket for carrying liquid coolant that absorbs heat generated by the engine during operation;

a first coolant circuit adapted to dissipate heat generated by the engine and comprised of at least one of a front cooler, a rear cooler, a left side cooler, and a right side cooler, the engine cooling jacket operatively connected in fluid communication with the coolers in the first coolant circuit and connected between an inlet and an outlet of the first coolant circuit;

a second coolant circuit adapted to dissipate heat generated by the engine and comprised of at least one of the front cooler, the rear cooler, the left side cooler, and the right side cooler, the engine cooling jacket operatively connected in fluid communication with the coolers in the second coolant circuit and connected between an inlet and an outlet of the second coolant circuit;

a coolant overflow reservoir positioned within each coolant circuit, the coolant overflow reservoir includes a separate coolant inlet for each coolant circuit and a single coolant outlet shared by each coolant circuit;

a pump for circulating coolant through the engine cooling jacket, the first and second coolant circuits; and a thermostat valve operatively connected to the second coolant circuit, the thermostat valve biased to a closed position blocking the pump's circulation of coolant at a location in the second coolant circuit without blocking coolant circulation in the first coolant circuit, the thermostat valve opened when the engine temperature exceeds a predetermined threshold permitting coolant circulation in the second coolant circuit to increase the engine heat dissipated.

2. The snowmobile of claim 1, wherein the outlets of the first and second coolant circuits share a common passage.

3. The snowmobile of claim 1, wherein the first coolant circuit includes the front cooler, rear cooler and the side coolers and the second coolant circuit includes the front cooler.

4. The snowmobile of claim 3 wherein the front cooler includes two inlets, one inlet for connection within each coolant circuit.

5. The snowmobile of claim 4, wherein the front coolant has a single outlet shared by each coolant circuit.

6. The snowmobile of claim 3 wherein the first coolant circuit comprises serial connections between the right side cooler, rear cooler, left side cooler, and front cooler.

7. The snowmobile of claim 6, wherein hoses connect the side coolers to the front and rear coolers in the first coolant circuit.

8. A snowmobile comprising:

a liquid-cooled engine containing a cooling jacket for carrying liquid coolant that absorbs heat generated by the engine during operation;

a first coolant circuit adapted to dissipate heat generated by the engine and comprised of at least one of a front cooler, a rear cooler, a left side cooler, and a right side cooler, the engine cooling jacket operatively connected in fluid communication with the coolers in the first coolant circuit and connected between an inlet and an outlet of the first coolant circuit;

a second coolant circuit adapted to dissipate heat generated by the engine and comprised of at least one of the front cooler, the rear cooler, the left side cooler, and the right side cooler, the engine cooling jacket operatively connected in fluid communication with the coolers in the second coolant circuit and connected between an inlet and an outlet of the second coolant circuit, the front cooler is the only cooler in the second coolant circuit;

a pump for circulating coolant through the engine cooling jacket and the first and second coolant circuits; and a thermostat valve operatively connected to the second coolant circuit, the thermostat valve biased to a closed position blocking the pump's circulation of coolant at a location in the second coolant circuit without blocking coolant circulation in the first coolant circuit, the thermostat valve opened when the engine temperature exceeds a predetermined threshold permitting coolant circulation in the second coolant circuit to increase the engine heat dissipated.

9. The snowmobile of claim 8, wherein the engine has two open coolant passages in fluid communication with the engine cooling jacket, the inlet and the outlet of the first coolant circuit connected to respective coolant passages.

10. The snowmobile of claim 9, wherein the outlets of the coolant circuits are connected to the same open coolant passage.

11. The snowmobile of claim 10, wherein the inlet of the second coolant circuit is connected to the thermostat valve.

12. The snowmobile of claim 8, wherein the thermostat valve is located in the engine.

13. The snowmobile of claim 8, wherein coolant continuously circulates through the first coolant circuit during engine operation.

14. A snowmobile comprising:

a liquid-cooled engine containing internal passages for carrying liquid coolant that absorbs heat generated by the engine during operation;

a first coolant circuit adapted to dissipate heat generated by the engine and comprised of at least one of a front cooler, a rear cooler, a left side cooler, and a right side cooler, the coolers in the first coolant circuit connected in fluid communication;

a second coolant circuit adapted to dissipate heat generated by the engine and comprised of at least one of the front cooler, the rear cooler, the left side cooler, and the right side cooler, the coolers in the second coolant circuit connected in fluid communication;

a pump for circulating coolant through the internal passages and the first and second coolant circuits;

the engine having an open coolant outlet connected to the first coolant circuit and through which the pump circulates coolant into the first coolant circuit; and the engine having a thermostat valve connected to the second coolant circuit and through which the pump circulates coolant into the second coolant circuit, the thermostat valve biased to a closed position blocking coolant flow from the cooling jacket into the second coolant circuit without blocking coolant flow into the first coolant circuit, the thermostat valve opened when the engine temperature exceeds a predetermined threshold permitting coolant circulation into the second coolant circuit to increase the engine heat dissipated, the first and second coolant circuits returning coolant to the engine via a common outlet, coolant circulation in the coolant circuits merges into a common flow path in one of the coolers so that an outlet of such cooler is shared by the coolant circuits.

15. The snowmobile of claim 14, wherein the front and rear coolers are mounted to a front and rear of a drive tunnel respectively.

16. The snowmobile of claim 14, wherein the pump is internal to the engine.

17. The snowmobile of claim 14, wherein the only cooler in the second coolant circuit is the front cooler.

18. The snowmobile of claim 14, wherein the front cooler has a separate inlet for connection to each coolant circuit and a single outlet shared by each coolant circuit.

19. The snowmobile of claim 14, further including a coolant overflow reservoir positioned within each coolant circuit.

20. The snowmobile of claim 14, wherein the overflow reservoir has a separate inlet for connection to each coolant circuit and a single outlet shared by each coolant circuit.

21. The snowmobile of claim 14, wherein coolant continuously circulates through the first coolant circuit during engine operation.

22. A snowmobile comprising:

a chassis including a longitudinally extending drive tunnel having an endless drive track disposed therein;

a pair of steerable skis secured to the chassis;

a liquid-cooled engine mounted in the chassis and containing a cooling jacket for carrying liquid coolant that absorbs heat generated by the engine during operation;

a first coolant circuit adapted to dissipate heat generated by the engine and comprised of at least one of a front cooler, a rear cooler, a left side cooler, and a right side cooler, the engine cooling jacket operatively connected in fluid communication with the coolers in the first coolant circuit and connected between an inlet and an outlet of the first coolant circuit;

a second coolant circuit adapted to dissipate heat generated by the engine and comprised of at least one of the front cooler, the rear cooler, the left side cooler, and the right side cooler, the engine cooling jacket operatively connected in fluid communication with the coolers in the second coolant circuit and connected between an inlet and an outlet of the second coolant circuit, one of the coolant circuits including at least two coolers, and another coolant circuit including at least one cooler; and a pump for circulating coolant through the engine cooling jacket and the first and second coolant circuits.

23. The snowmobile of claim 22 further including a thermostat valve operatively connected to the second coolant circuit.

24. The snowmobile of claim 23 wherein the thermostat valve is biased to a closed position blocking the pump's circulation of coolant at a location in the second coolant circuit without blocking coolant circulation in the first coolant circuit, the thermostat valve being opened when the engine temperature exceeds a predetermined threshold permitting coolant circulation in the second coolant circuit to increase the engine heat dissipated.

25. The snowmobile of claim 22, wherein the first coolant circuit includes the front cooler, rear cooler and the side coolers and the second coolant circuit includes the front cooler.

26. The snowmobile of claim 22, wherein coolant circulates through the coolant circuits during engine operation.

27. The snowmobile of claim 22, wherein at least one cooler is in both coolant circuits, the coolant circulation in the coolant circuits merges into a common flow path in the at least cooler that is in both circuits so that an outlet of such cooler is shared by the coolant circuits.

28. A snowmobile comprising:

a chassis including a longitudinally extending drive tunnel having an endless drive track disposed therein;

a pair of steerable skis secured to the chassis;

a liquid-cooled engine mounted to the chassis and containing a cooling jacket for carrying liquid coolant that absorbs heat generated by the engine during operation;

a first coolant circuit adapted to dissipate heat generated by the engine and comprised of at least one of a front cooler, a rear cooler, a left side cooler, and a right side cooler, the engine cooling jacket operatively connected in fluid communication with the coolers in the first coolant circuit and connected between an inlet and an outlet of the first coolant circuit;

a second coolant circuit adapted to dissipate heat generated by the engine and comprised of at least one of the front cooler, the rear cooler, the left side cooler, and the right side cooler, the engine cooling jacket operatively connected in fluid communication with the coolers in the second coolant circuit and connected between an inlet and an outlet of the second coolant circuit; and a pump for circulating coolant through the engine cooling jacket and the first and second coolant circuits, the first and second coolant circuits merging into a common coolant flow path in one of the coolers so that coolant is returned to the engine via a common outlet of the circuits.

29. The snowmobile of claim 28 further including a thermostat valve operatively connected to the second coolant circuit.

30. The snowmobile of claim 29 wherein the thermostat valve is biased to a closed position blocking the pump's circulation of coolant at a location in the second coolant circuit without blocking coolant circulation in the first coolant circuit, the thermostat valve being opened when the engine temperature exceeds a predetermined threshold permitting coolant circulation in the second coolant circuit to increase the engine heat dissipated.

31. The snowmobile of claim 28, wherein the first coolant circuit includes the front cooler, rear cooler and the side coolers and the second coolant circuit includes the front cooler.

32. The snowmobile of claim 28, wherein coolant circulates through the coolant circuits during engine operation.

33. The snowmobile of claim 28 further including a coolant overflow reservoir positioned within the coolant circuits, the coolant overflow reservoir including a separate coolant inlet for each coolant circuit and a single coolant outlet shared by each coolant circuit.

34. A snowmobile comprising:

a liquid-cooled engine containing a cooling jacket for carrying liquid coolant that absorbs heat generated by the engine during operation;

a longitudinally extending drive tunnel having an endless drive track disposed therein, the drive tunnel having a top portion defining an operator seat area and generally downwardly extending sidewalls positioned on opposite longitudinal sides of the track;

a first coolant circuit adapted to dissipate heat generated by the engine and comprised of at least one of a front cooler, a rear cooler, a left side cooler, and a right side cooler, the engine cooling jacket operatively connected in fluid communication with the coolers in the first coolant circuit, the front and rear coolers being mounted proximate to the longitudinal front and rear of the drive tunnel respectively, the left and right side coolers being mounted proximate to respective opposite sides of the track;

a second coolant circuit adapted to dissipate heat generated by the engine and comprised of at least one of the front cooler, the rear cooler, the left side cooler, and the right side cooler, the second coolant circuit excluding the coolers in first coolant circuit, the engine cooling jacket operatively connected in fluid communication with the coolers in the second coolant circuit; and a pump for circulating coolant from the engine cooling jacket through the first and second coolant circuits.

35. The snowmobile of claim 34 wherein coolant flowing through the second circuit does not merge with coolant flowing through the first circuit within one of the coolers.

36. The snowmobile of claim 34 further including a thermostat valve operatively connected to the second coolant circuit.

37. The snowmobile of claim 36 wherein the thermostat valve is biased to a closed position blocking the pump's circulation of coolant at a location in the second coolant circuit without blocking coolant circulation in the first coolant circuit, the thermostat valve being opened when the engine temperature exceeds a predetermined threshold permitting coolant circulation in the second coolant circuit to increase the engine heat dissipated.

38. The snowmobile of claim 36, wherein the first coolant circuit includes the front cooler, rear cooler and the side coolers and the second coolant circuit includes the front cooler.

39. The snowmobile of claim 36, wherein coolant continuously circulates through the first coolant circuit during engine operation.

* * * * *